US006849813B1

(12) United States Patent
Albrecht

(10) Patent No.: US 6,849,813 B1
(45) Date of Patent: Feb. 1, 2005

(54) STEP SWITCH WITH SELECTOR

(75) Inventor: Wolfgang Albrecht, Wenzenbach (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 09/554,291

(22) PCT Filed: Jun. 4, 1999

(86) PCT No.: PCT/EP99/03868

§ 371 (c)(1),
(2), (4) Date: May 9, 2000

(87) PCT Pub. No.: WO00/10182

PCT Pub. Date: Feb. 24, 2000

(30) Foreign Application Priority Data

Aug. 12, 1998 (DE) ..... 198 36 463

(51) Int. Cl.[7] ..... H01H 9/00; H01H 1/00
(52) U.S. Cl. ..... 200/11 TC; 200/18; 200/275
(58) Field of Search ..... 200/11 TC, 18, 200/275; 323/254, 255, 340, 341

(56) References Cited

U.S. PATENT DOCUMENTS 2,923,800 A * 2/1960 Borde et al. ..... 200/275
3,176,089 A * 3/1965 Bleibtreu et al. ..... 200/11 TC
3,396,254 A 8/1968 Bleibtreu
3,546,535 A 12/1970 Riemsdijk
4,931,599 A * 6/1990 Bleibtreu ..... 200/11 TC
6,495,779 B1 * 12/2002 Dobler et al. ..... 200/275

FOREIGN PATENT DOCUMENTS

| | | |
|---|---|---|
| DE | 1 249 990 | 11/1960 |
| DE | 22 10 642 | 9/1973 |
| DE | G 93 08 424.2 | 3/1994 |
| DE | 198 36 463 | 10/1999 |
| EP | 0 252 400 | 1/1988 |
| FR | 2 066 620 | 8/1971 |
| FR | 2 225 877 | 11/1974 |

OTHER PUBLICATIONS

On–Load Tap–Changer Type RS 16.
On–Load Tap–Changer Type RS 12.

* cited by examiner

*Primary Examiner*—James R. Scott
(74) *Attorney, Agent, or Firm*—Herbert Dubno

(57) ABSTRACT

The invention relates to a tap selector switch with a preselector for uninterrupted switching-over between different winding taps of a tapped transformer. The entire selector is in that case accommodated as a separate assembly in an own insulating material housing, and the fixed preselector contacts are constructed in circular form and arranged around a switch rod in different planes in the interior of this insulating material cylinder. Connection to them is made by preselector contact bridges, which are fastened to the switch rod, with radially resilient contact members.

7 Claims, 7 Drawing Sheets

STEP SWITCH WITH SELECTOR

CROSS REFERENCE TO RELATED APPLICATIONS

This is a national stage of PCT/EP99/03868 filed 4 Jun. 1999 and based upon German national application 198 36 463.6 of 12 Aug. 1998 under the International Convention.

FIELD OF THE INVENTION

Tap selector switches have been built into transformers for many years in order to be able to set the voltage, active power and reactive power of electrical mains under load by changing the transformation ratio.

Known tap selector switches are known in two basic forms of construction: in one form of construction, they consist of the separate assemblies of tap selector switch and load change-over switch and in the second form of construction these two assemblies are united into one load selector switch which carries out both functions. The term "tap selector switch" used here should be understood to encompass both aforesaid forms of construction.

The setting of the transformation ratio takes place in steps; for this purpose, the transformer is equipped with a tapped winding, connection with the taps of which can be made by the tap selector switch.

To increase the range of settings, it has long been usual to equip the tap selector switch with a preselector. This known preselector can, in principle, realize both the known functions as has been illustrated schematically in FIGS. 1*a* and 1*b*.

It can serve for additive or subtractive switching of the tap winding, as shown in FIG. 1*a*, or for switching of the tap winding to the beginning or t he end of a coarse stage, as shown in FIG. 1*b*. In each case, the setting range for the same length of the tapped winding is doubled by the preselector.

The preselector 100 consists of, in total, three fixed preselector contacts, wherein a respective one of the two fixed contacts "+" or "−" is connected with the third fixed contact "0" according to switch setting. These known preselector switches are known in numerous forms of construction and with the most diverse kinds of contact and actuating mechanisms.

A tap selector switch, which is disposed in the interior of an insulating material cylinder and the preselector of which extends externally of this insulating material cylinder in the 2 longitudinal direction thereof, is known from the Bulgarian company brochures "On-Load Tap Changer Type RS12" and "On-Load Tap Changer Type 16". The fixed preselector contacts are arranged in a line in the contact sequence "+" ù"O"ù"−" or "−""0""+" and are actuated linearly by a switch rod displaceable in longitudinal direction.

This switch rod displaceable in longitudinal direction comprises a preselector contact bridge for each phase. The bridge enables one of the two fixed preselector contacts "+" or "−" to be selectively connected each time with the further fixed preselector contact "0", which is arranged therebetween and forms the root connection of the preselector.

The longitudinal movement of the described switch rod is picked up by a special gear train from a Geneva gear which is situated at the upper side of the tap selector switch and produces the rotational movement of the switch shaft in the interior of the insulating material cylinder of the tap selector switch for actuation of the selector contacts.

However, this known tap selector switch with its external, linearly actuatable preselector has several disadvantages.

On the one hand, appreciable accuracy requirements have to be fulfilled due to the large length dimension of the entire preselector arrangement. Even the smallest tolerances between the fixed preselector contacts on the one hand as well as between these and the movable preselector contact bridge on the other hand lead have the consequence that a fault-free running-up of the contact bridge onto the fixed contacts to be electrically connected together is not possible. This problem is further increased in the course of the operating life by contact erosion and mechanical wear of the contacts. In order to reduce inaccuracies, a special guidance of the switch rod is additionally required. Moreover, the capacitive switching power of the preselector is also limited by the chosen contact arrangement in the case of the known tap selector switch.

The object of the invention is to provide an improved tap selector switch with an external, linearly actuated preselector, in which an expensive guidance of the switch rod carrying the preselector contact bridge is not necessary, but a reliable switching with substantially constant contact forces is possible.

Moreover, the tap selector switch according to the invention with preselector should also be suitable for high voltage loads at the preselector.

SUMMARY OF THE INVENTION

This object is met according to the invention by a tap selector switch with a preselector for uninterrupted switching-over between different winding taps of a tapped transformer, wherein fixed preselector contacts are arranged in a line, separated according to phases to be switched and externally of the tap selector switch in the longitudinal direction thereof, and are actuatable by a switch rod displaceable in the longitudinal direction and wherein the switch rod comprises, for each phase to be switched, an electrically conductive preselector contact bridge, which is dimensioned in such a manner that two adjacent fixed preselector contacts can be bridged over at a time.

According to the invention the entire preselector is accommodated as an assembly separate from the tap selector switch and in a separate insulating-material housing, in the interior of which the switch rod extends. The fixed preselector contacts are constructed in the form of a circle and are arranged concentrically around the switch rod in different planes in the interior of the insulating material housing. Radially resilient contact members are arranged at each of the preselector contact bridges in such manner that they can each be urged inwardly against a spring force on running-up onto one of the fixed preselector contacts.

Each of the preselector contact bridges can comprise a contact carrier which at least partially surrounds the switch rod and at which the contact members are arranged.

The spring effect of the contact members is achieved by respective spring pairs which bear against the switch rod or the contact carrier. The spring travel of the contact members is limited by upper and lower abutments. The spring travel of the contact members can be limited by transverse pins (21), which are guided in respective bores, with an outer abutment.

The individual contact members can be narrowed in their middle regions i.e. drawn in inwardly, in such a manner that a double interruption, i.e. a simultaneous departure from each of the two adjacent fixed selector contacts with which contact was made previously, takes place on actuation.

It is a particular advantage of the invention that the longitudinally displaceable switch rod of the preselector does not require;any special guidance and that the drive system overall does not have to fulfil any special accuracy demands. Rather, a virtually self-adjusting contact system with constant contact forces is achieved by the construction of the self-centering preselector contact bridge.

In addition, the annular construction, according to the invention, of the fixed preselector contacts permits high loads. The preselector designed in accordance with the invention also permits high capacitive switching powers to be managed so that it will be necessary to provide additional polarity resistors in only a few special cases. Overall, a compact, stable and simple construction is given by the use of a separate insulating material tube. The complete preselector can be prefabricated in simple manner as a complete assembly and fastened in equally simple manner laterally to the insulating-material cylinder of the tap selector switch.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
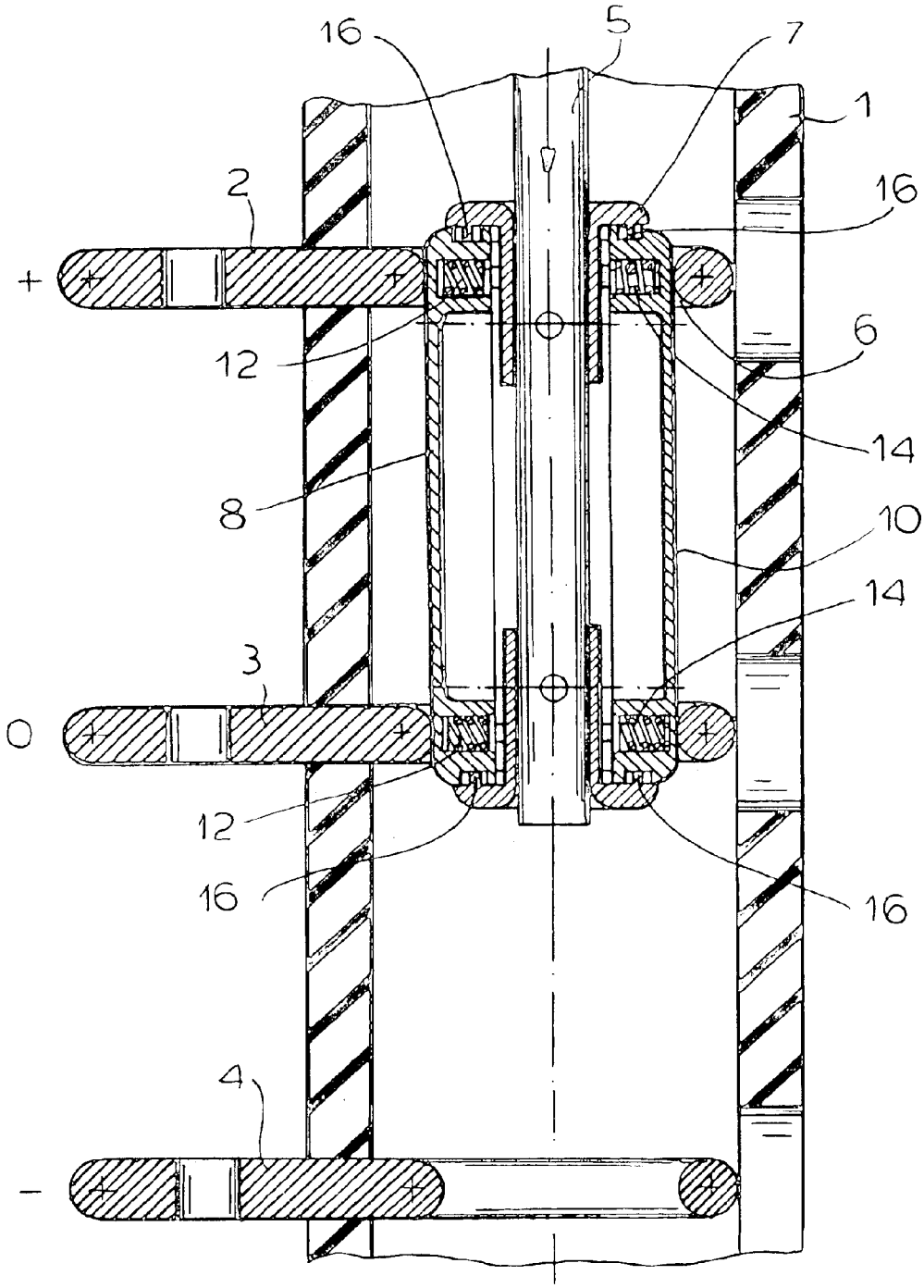
FIG. 2 is a cross sectional view of a first embodiment of a preselector according to the invention.
Figure 3:
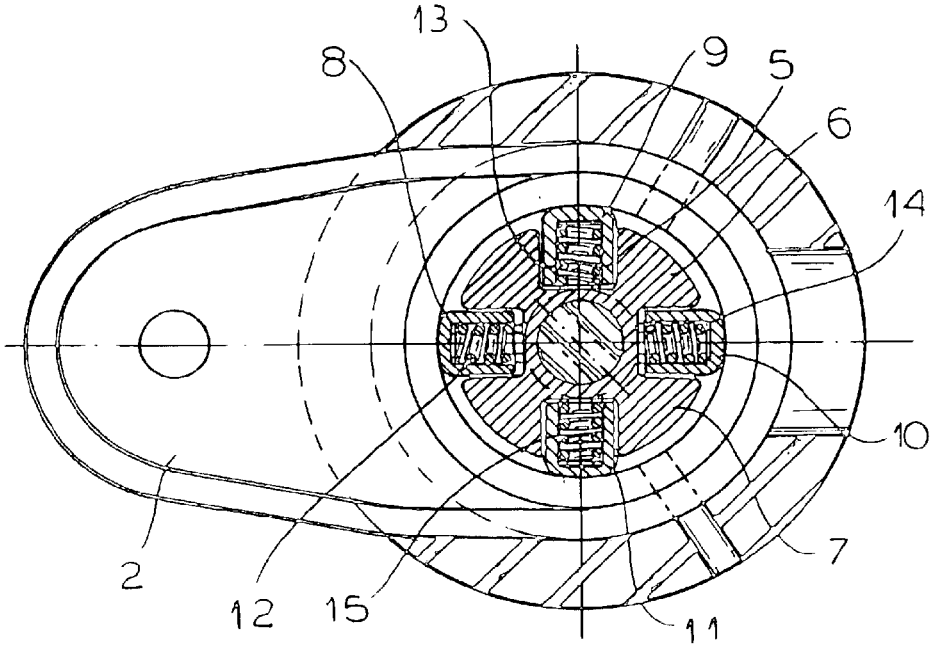
FIG. 3 shows this embodiment in sectional view from above.

The first embodiment illustrated in FIGS. 2 and 3 shows a preselector which comprises a tubular insulating material housing 1 as supporting component. The fixed preselector contacts 2, 3 and 4, shown here for only one phase, are arranged at the inward side of the wall of this insulating material housing 1 and penetrate this by their contact feed lines. Each of the fixed preselector contacts is in that case constructed to be of circular shape concentric with the insulating material housing 1.

Figure 1A:
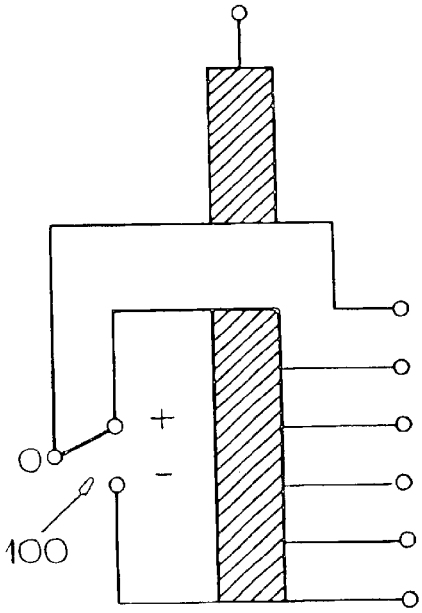
FIG.1a PRIOR ART
FIGS. 1*a* and 1*b* are diagrams which show the already-explained basic preselector circuits according to the state of the art.
Figure 1B:
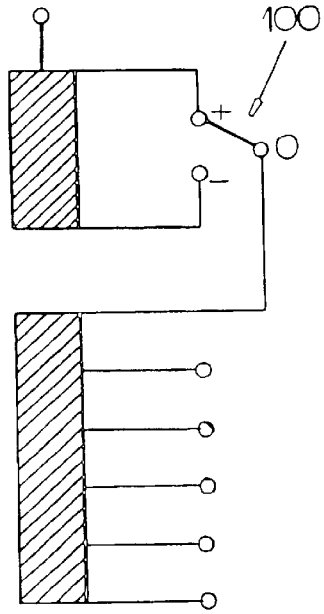
FIG.1b PRIOR ART

The contact 2 has the function of the contact "+" of FIG. 1, contact 3 the function of the contact "0" and contact 4 the function of the contact "−" of FIG. 1. A longitudinally displaceable switch rod 5, which carries the preselector contact bridge 6, is arranged in the interior of the insulating material housing 1. The preselector contact bridge 6 consists of an annular contact carrier 7, which surrounds the switch rod 5 and is fastened thereto and at which radially movable, resiliently mounted contact members 8, 9, 10 and 11 are arranged. These contact members 8, 9, 10 and 11 are urged radially outwards by respective spring pairs 12, 13, 14 and 15 in such a manner that a defined contact pressure is produced on running-up onto the respective fixed contacts 2, 3 and 4.

The limitation of the radial travel of the contact members 8, 9, 10 and 11 is effected by respective abutments 16 at the top and at the bottom at the contact carrier 7.

FIG. 2 shows the preselector according to the invention in the same switch setting as in FIG. 1, in which connection is made to the contacts "+" and "0". When the preselector is actuated, the switch rod 5 is moved downwardly, this being indicated by an arrow in FIG. 2, and the contact carrier 7 leaves the preselector contact 2 and runs downwards guided by the preselector contact 3 and remaining in contact therewith. Finally, it runs up on the preselector contact 4 and thereby produces the new connection of this preselector contact. 4, with the function "", to the preselector contact 3. The switching-over is completed.

Figure 4:
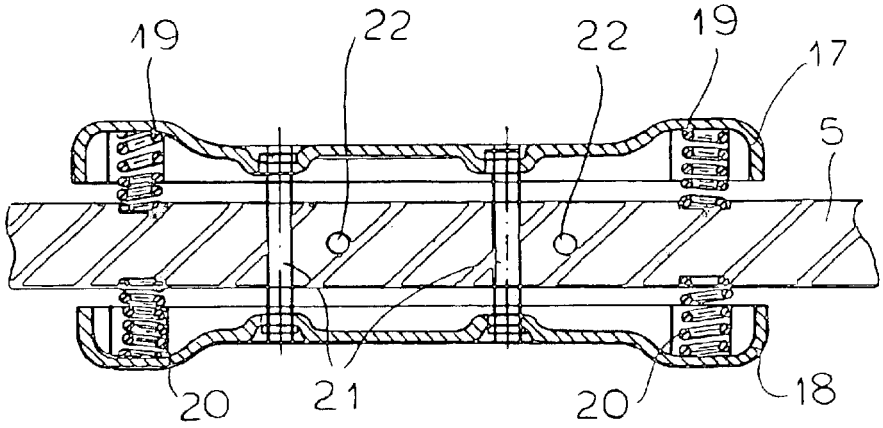
FIG. 4 shows an alternative form of construction of a preselector contact bridge.

FIG. 4 shows another embodiment of a preselector contact bridge. In this case, contact members disposed opposite each other in pairs are present directly at the switch rod 5; of these four contact members in total, the two contact members 17 and 18 are illustrated in sectional representation. The contact members 17 and 18 are in turn urged outwardly by spring pairs 19 and 20. The travel limitation is effected in this case by transverse pins 21, which are guided in bores of the respective contact members 17 and 18, with an outer abutment. The two further contact members not illustrated in the sectional representation are limited in analogous manner by further transverse pins 22 in a plane at 90 degrees to the plane of pins 21.

Figure 5:
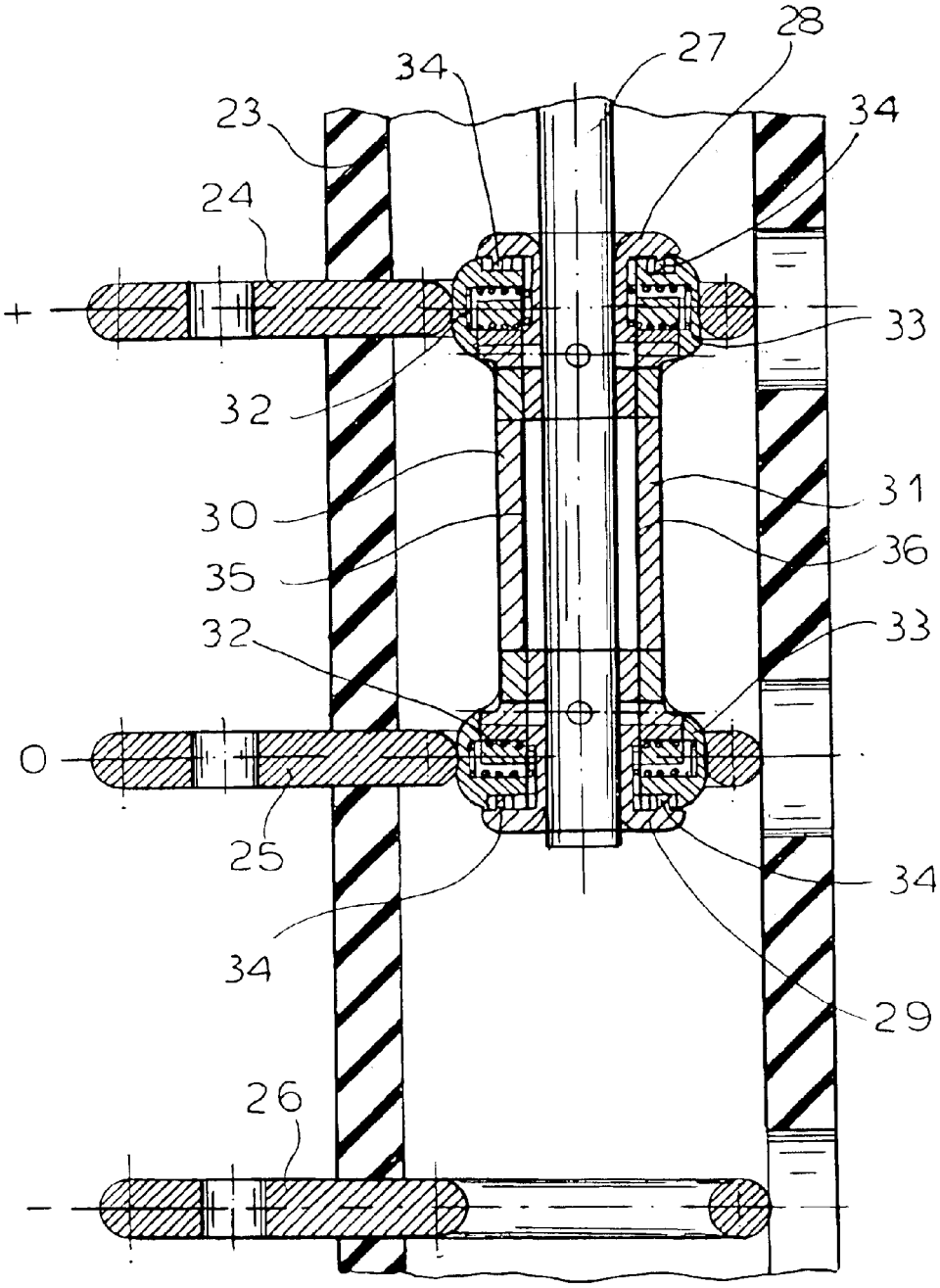
FIG. 5 shows a second embodiment of a preselector according to the invention again in schematic lateral sectional illustration.

FIG. 5 shows a second embodiment of a preselector according to the invention in a lateral sectional illustration. In this case, a tubular insulating material housing 23 is again provided as supporting component. The fixed preselector contacts 24, 25 and 26, which are again formed to be of circular shape and extend concentrically with the insulating material housing 23, are again arranged at the inward side of the wall of this insulating material housing 23. In this embodiment, too, a longitudinally displaceable switch rod 26, which again carries a preselector contact bridge 28, is arranged in the interior of the insulating material housing 23.

This preselector contact bridge 28 consists, as already explained in the first embodiment, of an annular contact carrier 29, at which radially movable, resiliently mounted contact members are arranged, of which only two mutually opposite contact members 30 and 31 are illustrated in the sectional representation. Each of these contact members is urged radially outwards by spring pairs, the spring pairs 32 and 33 being illustrated here. The limitation of the radial travel of the individual contact members is again effected by upper and lower abutments 34. By contrast to the first embodiment illustrated in FIGS. 2 and 3, the individual contact members, the contact members 30 and 31 illustrated here, are set inwardly in their middle region 35 and 36.

Instead of the preselector contact bridge illustrated in FIG. 5, an embodiment as in FIG. 4 with travel limitation by transverse pins provided with an abutment is also possible.

The described constriction in the respective middle region is particularly important for the function of the second embodiment illustrated in FIG. 5.

Due to this constriction, a double-pole interruption and switching-over function of the preselector takes place. When the preselector is actuated, i.e. the switch rod 27 is moved downwardly, the contact members 30 and 31 leave not only the contact 24, but also the contact 25 and, on further movement, they run simultaneously onto the contact 26 as well as the. contact 25.

Figure 6:
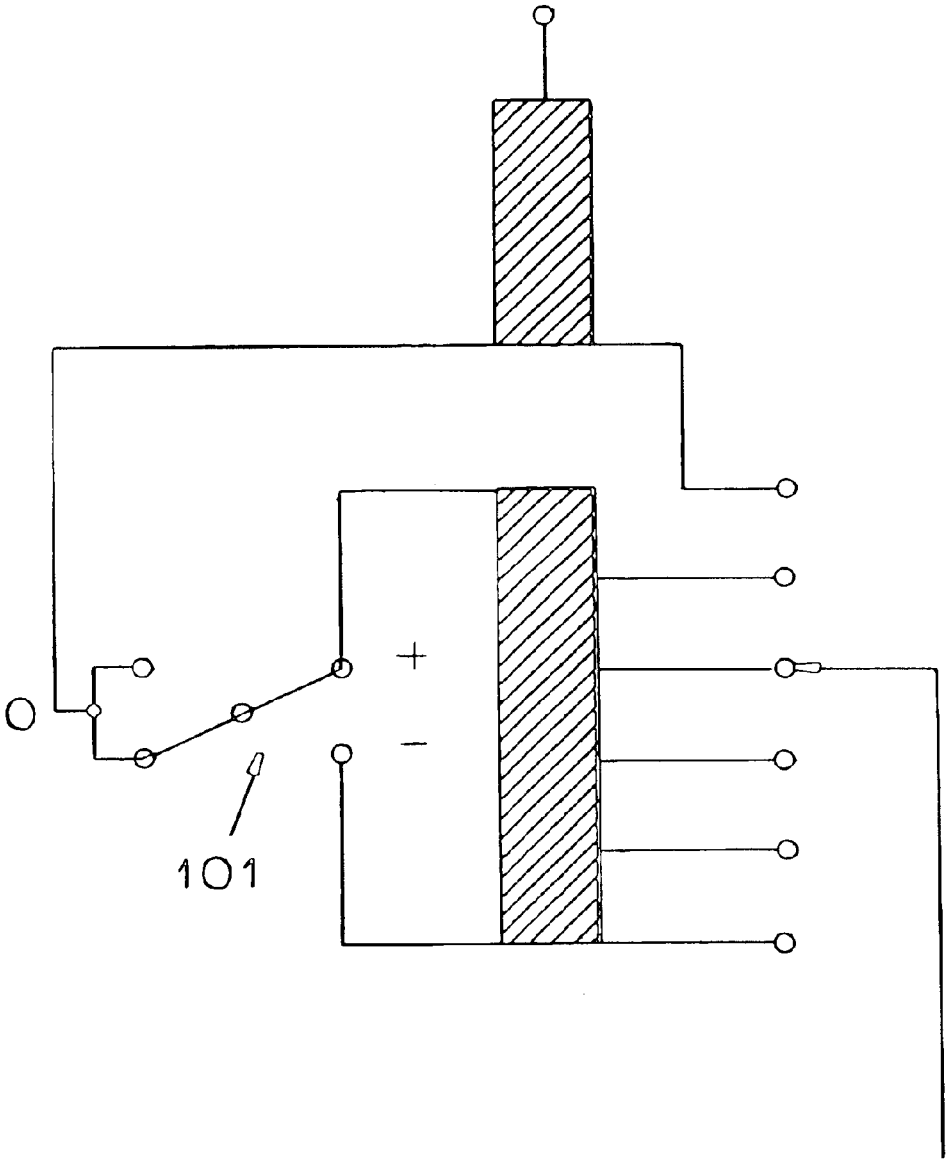
FIG.6 PRIOR ART
FIG. 6 shows the circuit, which is known per se, of the second embodiment illustrated in FIG. 5.

FIG. 6 shows the basic circuit of such a preselector 101 switching over in bipolar manner, here acting as reverser. In both embodiments of the preselector, an automatic centering during the running-up of the contact members is ensured by the concentric formation of the fixed preselector contacts on the one hand and the resilient arrangement of these contacts on the switch rod on the other hand. Thereby, a uniform contact-making distributed over all participating individual contact members is always guaranteed even in the case of unavoidable tolerances of the switch rod, the fixed preselector contacts or even the contact members.

Figure 7:
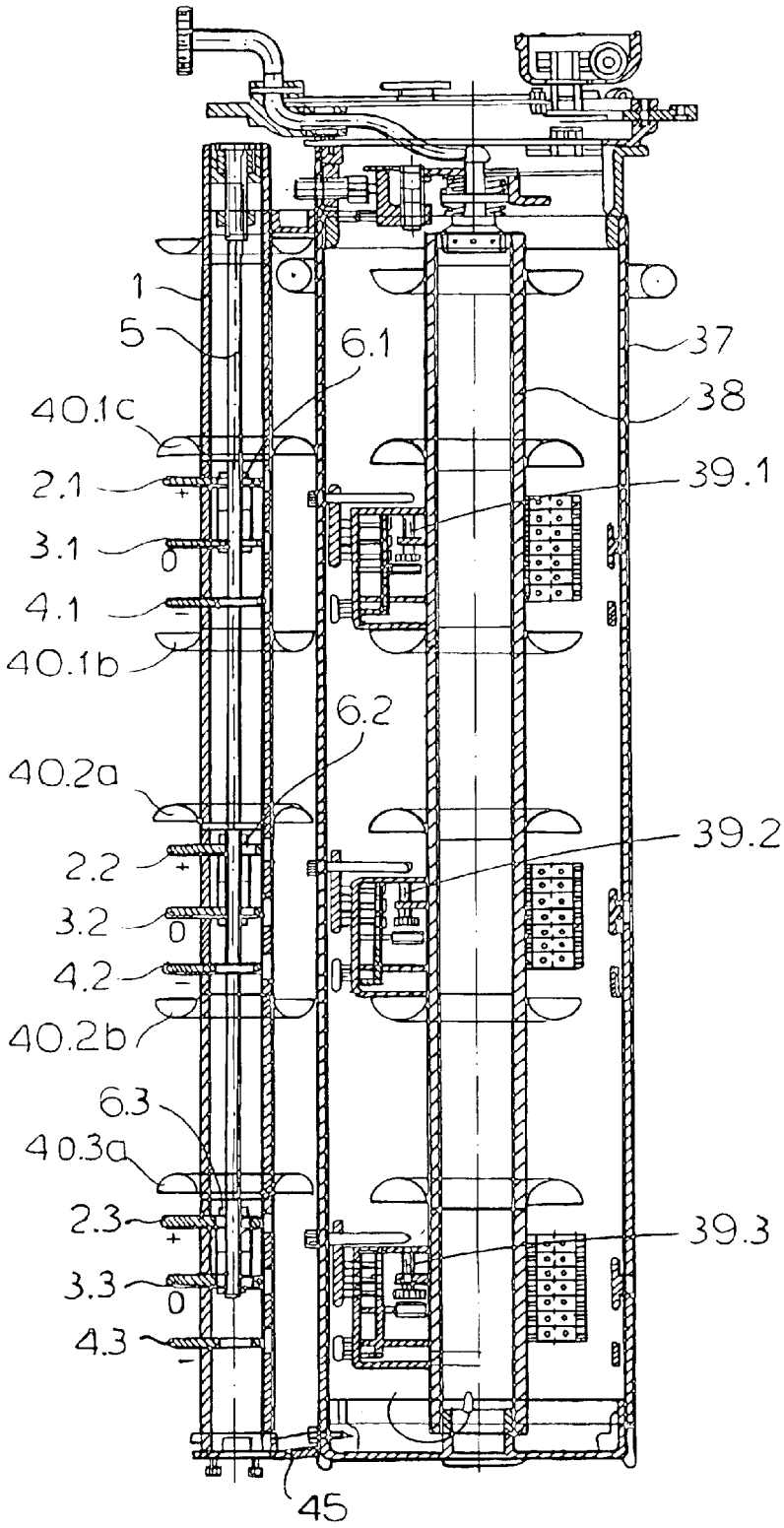
FIG. 7 shows a complete tap selector switch according to the invention illustrated in schematic lateral sectional illustration, here consisting of a load selector switch which combines the functions of the tap selector switch as well as the load change-over switch and the laterally arranged preselector.
Figure 8:
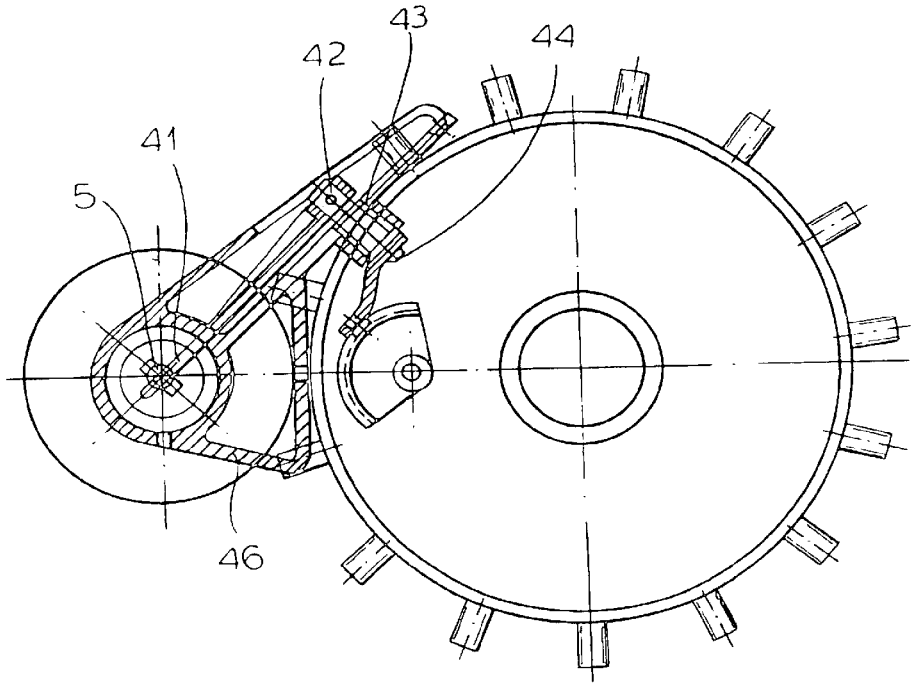
FIG. 8 shows the tap selector switch with preselector illustrated in FIG. 7 schematically from above.

A complete tap selector switch with a preselector according to the invention arranged laterally, here with the first embodiment with the simple interruption illustrated in FIGS. 2 and 3, is shown in FIGS. 7 and 8.

The actual tap selector switch is here constructed as a load selector switch and disposed in an insulating material cylinder 37. A rotatable insulating-material rod 38, which for each of the three phases carries a switch element 39.1, 39.2 and 39.3 with the movable contacts and further switching means, extends in known manner through the tap selector switch in the interior. The fixed tap selector contacts, to which connection can be made, are respectively arranged in the wall of the insulating material cylinder 37 in correspondence with the movable contacts. Since the function of such a load selector is sufficiently well known, the remaining components are not discussed in detail. The preselector switch according to the invention is disposed in an insulating material cylinder 1 laterally of the tap selector switch and fastened thereto by a crossbeam 45. Disposed in the interior of this insulating material cylinder 1 is the switch rod 5, and the already-described three fixed preselector contacts are arranged for each of the three phases, i.e. the contacts 2.1, 3.1 and 4.1 for one phase, the contacts 2.2, 3.2 and 4.2 for the second phase and the contacts 2.3, 3.3 and 4.3 finally for the third phase. A preselector contact bridge 6.1, 6.2 and 6.3 for each phase is arranged in correspondence with the respective contacts. On actuation of the preselector by displacement of the switch rod downwardly, the contact members of the preselector contact bridges 6.1, 6.2 and 6.3 initially simultaneously leave, thus in all three phases, the corresponding contacts 2.1, 2.2 and 2.3, i.e. the "+" contacts, run downwardly onto the respective "0" contacts 3.1, 3.2 and 3.3 and finally make contact with the respectively "" contacts 4.1, 4.2 and 4.3.

In each horizontal plane associated with a certain phase, the regions of the fixed preselector contacts are respectively screened by upper screens 40.1*a*, 40.2*a* and 40.3*a* and lower screens 40.1*b* and 40.2*b*.

The switch rod 5 is provided at its upper end with a lever 41, which is mounted by means of a transverse pin 42 in a bearing 43 in the region of the tap selector switch head. This transverse pin 42 in turn stands in connection with a crank 44, which at its free end derives a pivot movement from the Geneva drive of the tap selector switch. The pivot movement of the crank 44, which at the same time marks the bearing point, is converted to a pivot movement of the lever 41 in vertical direction, which is transmitted to the switch rod 5. The described actuating mechanism is pivotably connected to an upper crossbeam 46, which at the same time provides the upper fastening of the preselector to the tap selector switch.

What is claimed is:

1. A preselector for an elongated tap selector switch of a tapped transformer comprising:

a longitudinally extending housing of insulating material separate from the tap selector switch and extending therealong;

a switch rod longitudinally displaceable in said housing;

for each of a plurality of phases to be switched, a plurality of fixed preselector contacts mounted in said housing and spaced apart in a direction of displacement of said switch rod, each of said fixed preselector contacts having a circular portion concentrically surrounding said switch rod; and a respective contact bridge on said rod for each of said phases and adapted to selectively bridge between pairs of said preselector contacts of the respective phase upon displacement of said switch rod, each said contact bridge comprising a plurality of radially resilient contact members arranged around the switch rod and of a length sufficient to bridge between the pairs of preselector contacts such that each of said contact members is urged inwardly against a spring force as the respective contact bridge runs onto a preselector contact.

2. The preselector defined in claim 1 wherein each of said contact bridges comprises a contact carrier at least partially surrounding said switch, said contact members being arranged on said contact carriers.

3. The preselector defined in claim 2 wherein each of said contact members has a pair of springs spaced apart in said direction and braced between the respective contact carrier and contact member.

4. The preselector defined in claim 1 wherein each of said contact members has a pair of springs spaced apart in said direction and braced between said switch rod and the contact member.

5. The preselector defined in claim 1 further comprising upper and lower abutments on said switch rod and limiting radial displacement of said contact members by the respective spring force.

6. The preselector defined in claim 1 further comprising transverse pints guided in respective bores and limiting radial displacement of said contact members by said spring force.

7. The preselector defined in claim 1 wherein said contact members have narrowed middle regions whereby each further comprising transverse pins guided in respective bores and limiting radial displacement of said contact members by said spring force.

* * * * *